US010392773B2

(12) United States Patent
Fuerst

(10) Patent No.: US 10,392,773 B2
(45) Date of Patent: Aug. 27, 2019

(54) LINKAGE ASSEMBLY FOR MACHINE

(71) Applicant: Caterpillar SARL, Geneva (CH)

(72) Inventor: Gerald Michael Fuerst, Cary, NC (US)

(73) Assignee: Caterpillar SARL, Geneva (CH)

( * ) Notice: Subject to any disclaimer, the term of this patent is extended or adjusted under 35 U.S.C. 154(b) by 367 days.

(21) Appl. No.: 15/238,745

(22) Filed: Aug. 17, 2016

(65) Prior Publication Data

US 2018/0051439 A1 Feb. 22, 2018

(51) Int. Cl.
*E02F 3/34* (2006.01)
*E02F 3/38* (2006.01)

(52) U.S. Cl.
CPC ..... *E02F 3/38* (2013.01); *E02F 3/3414* (2013.01)

(58) Field of Classification Search
CPC ..... E02F 3/3414
See application file for complete search history.

(56) References Cited

U.S. PATENT DOCUMENTS 2,775,356 A * 12/1956 Lessmann ..... E02F 3/3405 414/715
3,487,964 A * 1/1970 Riley ..... B60P 1/5433 212/243
4,185,945 A * 1/1980 Gill ..... E02F 3/30 414/727
5,437,531 A * 8/1995 Kress ..... B66C 23/54 212/304
7,470,100 B2 12/2008 Jeffrey et al.
2005/0196262 A1* 9/2005 Yamashita ..... E02F 3/3405 414/685
2014/0271078 A1* 9/2014 Koch ..... E02F 3/3414 414/723
2016/0060842 A1* 3/2016 Fuerst ..... E02F 3/3405 414/685

FOREIGN PATENT DOCUMENTS

EP 1211357 A1 * 6/2002 ..... E02F 3/308
EP 1559837 A1 * 8/2005 ..... E02F 3/3405
JP 2004143668 A * 5/2004 ..... E02F 3/3405

* cited by examiner

*Primary Examiner* — Gerald McClain

(57) ABSTRACT

A four-bar assembly for a linkage assembly includes an arm pivot pin pivotally coupling a front arm with a rear arm of the linkage assembly. The arm pivot pin forms a first vertex of the four-bar assembly. A distal end of the front arm forms a second vertex of the four-bar assembly. The four-bar assembly includes a tilt cylinder having a first end and a second end. The first end of the tilt cylinder is pivotally coupled to a bracket angularly extending from the rear arm at a first end pin. The first end pin forms a third vertex of the four-bar assembly and the second end of the tilt cylinder forms a fourth vertex of the four-bar assembly respectively. An angle formed at the arm pivot pin and defined between the rear arm and the bracket lies between 0 and 90 degrees.

18 Claims, 4 Drawing Sheets

LINKAGE ASSEMBLY FOR MACHINE

TECHNICAL FIELD

The present disclosure relates to a linkage assembly for a machine.

BACKGROUND

Skid steer loaders are highly maneuverable compact work machines. These machines are commonly used in a variety of applications ranging from asphalt milling to earth moving, depending on the job and type of attachment being utilized. One particular capability for which the skid steer loaders are utilized is gathering materials, moving the materials, and depositing the materials in a dump truck or container.

Typically, the loaders have left and right interconnected lift arms pivotally mounted to respective tower portions of the body near the rear of the loader, and an implement, such as a bucket, is attached at the front ends of the lift arms. Hydraulic lift actuators are connected between the body and the lift arms to raise and lower the lift arms, and one or more hydraulic actuators are connected between the lift arms and the implement to tilt the implement relative to the lift arms. As the implement is lifted, these designs do not have any provision of restricting the movement of the implement in case of an error while operating the machine. In some cases, if the implement is rotated beyond a fixed angle, the implement may make contact with an operator cab of the machine.

U.S. Pat. No. 2,775,356, hereinafter referred to as '356 patent, describes a front-end-loading portable power shovel. The power shovel includes a power-propellable frame and a pair of lift-arms arranged on opposite sides of the frame. The power shovel includes forward extension-arms pivotally connected to the lift-arms for up and down movement. The power shovel further includes a shovel having its rearward portion pivotally connected to the forward ends of the extension-arms, and a hydraulic cylinder-assembly operatively inter-posed between the shovel and the extension-arms. The shovel may swing about the pivotal connection with the extension-arms by an obtuse angle. There is no arrangement provided to prevent the shovel from colliding with the operator cab if erroneously operated.

Hence there is a need for an improved linkage assembly.

SUMMARY

In an aspect of the present disclosure, a four-bar assembly for a linkage assembly is provided. The four-bar assembly includes an arm pivot pin pivotally coupling a front arm with a rear arm of the linkage assembly. The arm pivot pin forms a first vertex of the four-bar assembly. A distal end of the front arm forms a second vertex of the four-bar assembly. The four-bar assembly further includes a tilt cylinder having a first end and a second end. The first end is pivotally coupled to a bracket angularly extending from the rear arm at a first end pin. The first end pin is adapted to form a third vertex and the second end is adapted to form a fourth vertex of the four-bar assembly respectively. An angle formed at the arm pivot pin and defined between the rear arm and the bracket lies between 0 and 90 degrees.

In another aspect of the present disclosure, a linkage assembly for a machine is provided. The linkage assembly includes a front arm and an associated extension cylinder connected therewith. The linkage assembly includes a rear arm and an associated lift cylinder connected therewith. The linkage assembly further includes a four-bar assembly associated with the front arm and the rear arm. The four-bar assembly includes an arm pivot pin pivotally coupling the front arm with the rear arm. The arm pivot pin forms a first vertex of the four-bar assembly. A distal end of the front arm forms a second vertex of the four-bar assembly. The four-bar assembly further includes a tilt cylinder having a first end and a second end. The first end is pivotally coupled to a bracket angularly extending from the rear arm at a first end pin. The first end pin forms a third vertex and the second end forms a fourth vertex of the four-bar assembly respectively. An angle formed at the arm pivot pin and defined between the rear arm and the bracket lies between 0 and 90 degrees.

In yet another aspect of the present disclosure, a machine is provided. The machine includes a frame and a linkage assembly coupled to the frame. The linkage assembly includes a front arm and an associated extension cylinder connected therewith. The linkage assembly includes a rear arm and an associated lift cylinder connected therewith. The linkage assembly includes a four-bar assembly associated with the front arm and the rear arm. The four-bar assembly includes an arm pivot pin pivotally coupling the front arm with the rear arm. The arm pivot pin forms a first vertex of the four-bar assembly. A distal end of the front arm forms a second vertex of the four-bar assembly. The four-bar assembly further includes a tilt cylinder having a first end and a second end. The first end is pivotally coupled to a bracket angularly extending from the rear arm at a first end pin. The first end pin forms a third vertex and the second end forms a fourth vertex of the four-bar assembly respectively. An angle formed at the arm pivot pin and defined between the rear arm and the bracket lies between 0 and 90 degrees. The machine further includes a work tool coupled to the second end of the tilt cylinder and the distal end of the front arm.

DETAILED DESCRIPTION

Figure 1:
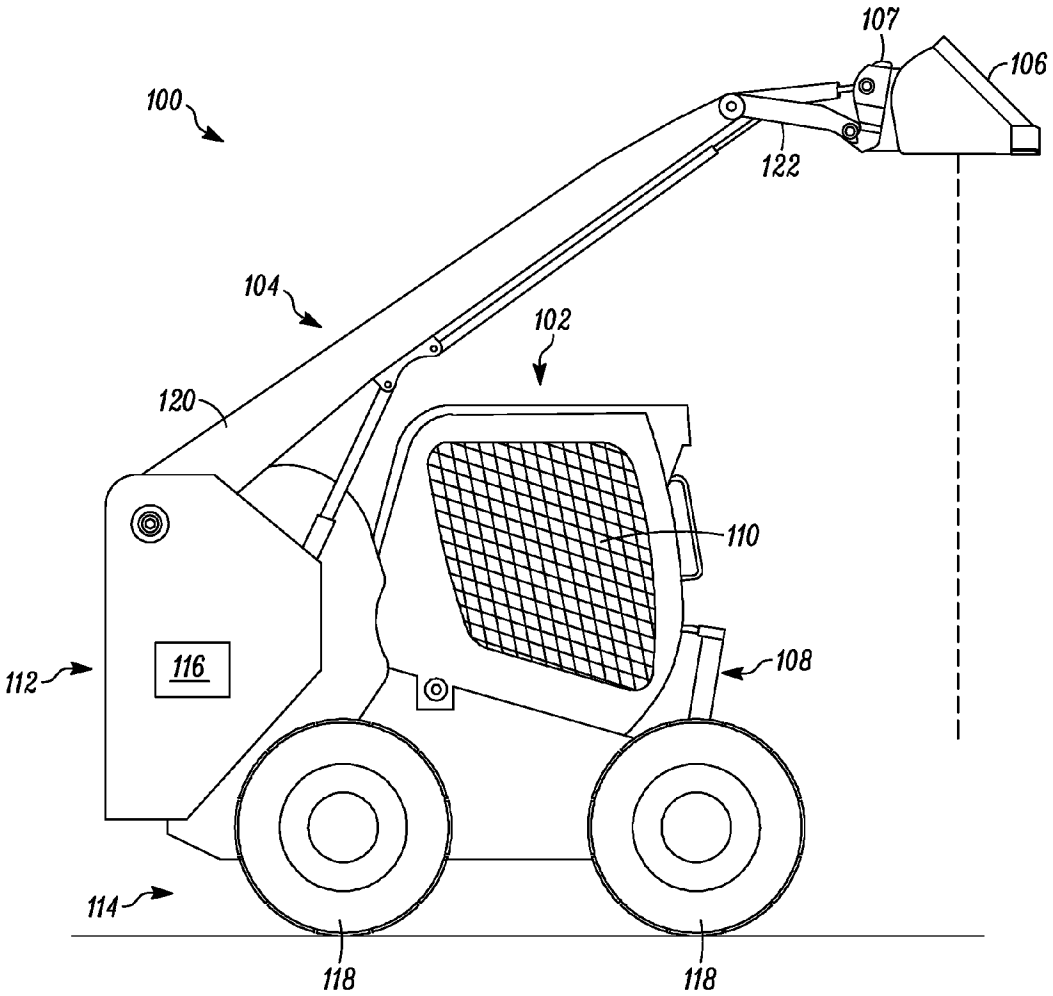
FIG. 1 is a side view of an exemplary machine with an implement in a raised position, according to one embodiment of the present disclosure.

Wherever possible, the same reference numbers will be used throughout the drawings to refer to same or like parts. FIG. 1 illustrates an exemplary machine 100 having various systems and components that cooperate to accomplish a task. The machine 100 is embodied as a skid steer loader. Alternatively, the machine 100 may embody any other fixed or mobile machine that performs some type of operation associated with an industry such as mining, construction, farming, transportation, or another industry known in the art. For example, the machine 100 may be an earth moving machine such as, but not limited to, an excavator, a dozer, a loader, a backhoe, and a motor grader.

The machine 100 includes a frame 102 and a linkage assembly 104 configured to move a work tool 106. The work tool 106 is attached to the linkage assembly via a quick coupler 107. In an embodiment, the work tool 106 may be attached directly to the linkage assembly 104. The frame 102 includes a forward portion 108, an operator station 110 that may include control interfaces (not shown) for control of the linkage assembly 104, a rear portion 112, a drive system 114 for propelling the machine 100, and a power source 116 or other prime mover that provides power to the linkage assembly 104 and/or the drive system 114. The machine 100 may additionally include various other components such as a transmission, exhaust system, sensors etc. not described herein.

The drive system 114 includes one or more traction devices powered to propel the machine 100. As illustrated in FIG. 1, the drive system 114 includes a first set of wheels 118 located on one side of the machine 100, and a second set of wheels (not shown) located on an opposite side of the machine 100. The first set of wheels 118 may be driven by a first travel motor (not shown), and the second set of wheels may be driven by a second travel motor (not shown). It is contemplated that the drive system 114 could alternatively include traction devices other than wheels, such as, belts, tracks or other known traction devices.

The power source 116 may include a combustion engine such as, for example, a reciprocating compression ignition engine, a reciprocating spark ignition engine, a combustion turbine, or another type of combustion engine known in the art. The power source 116 may produce a mechanical or electrical power output that may then be converted to hydraulic power for moving the linear or rotary actuators of the linkage assembly 104. The operator station 110 may include one or more control devices (not shown) for electro-hydraulic control of the linkage assembly 104 of the machine 100. The control devices may include one or more joysticks provided within the operator station 110, and adapted to receive an input from an operator indicative of a desired movement of the machine 100 and/or the linkage assembly 104.

Figure 2:
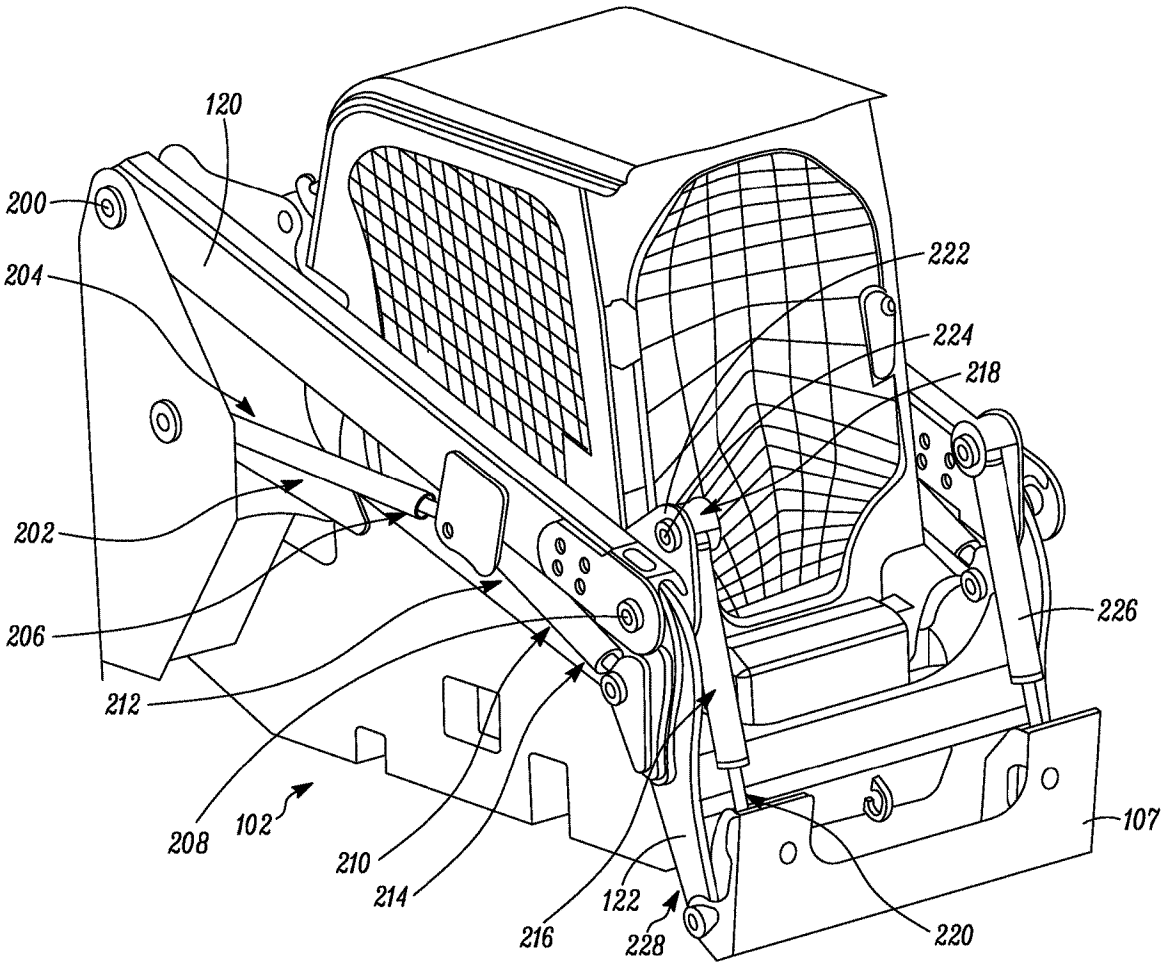
FIG. 2 is perspective view of a linkage assembly of the machine of FIG. 1.

Referring to FIGS. 1 and 2, the linkage assembly 104 includes a pair of rear arms 120 and a pair of front arms 122. Further description of the linkage assembly 104 would be made by referring to only a single rear arm 120 and a single front arm 122 for the purpose of simplicity. The rear arm 120 is pivotally connected to the frame 102 of the machine 100 by a pivot pin 200. The rear arm 120 may rotate about the pivot pin 200. A lift cylinder 202 is provided to effect the rotational movement of the rear arm 120 about the pivot pin 200. The lift cylinder 202 may be actuated through hydraulic or pneumatic means. The power source 102 may provide the lift cylinder 202 with power required to actuate the rear arm 120. The lift cylinder 202 has a first end 204 attached to the frame 102 of the machine 100 and a second end 206 attached to the rear arm 120. In the illustrated embodiment, the first and second ends 204, 206 of the lift cylinder 202 are a head end and a rod end of a hydraulically/pneumatically actuated cylinder respectively. In other embodiments, the first and second ends 204, 206 of the lift cylinder 202 may also be the rod end and the head end of a hydraulically/pneumatically actuated cylinder respectively.

The linkage assembly 104 further includes the front arm 122 pivotally coupled to the rear arm 120 via an arm pivot pin 208. The front arm 122 may rotate about the arm pivot pin 208. An extension cylinder 210 provides the required force for the front arm 122 to rotate about the arm pivot pin 208. The extension cylinder 210 may be actuated through hydraulic or pneumatic means. The power source 102 may provide the extension cylinder 210 with power required to actuate the front arm 122. The extension cylinder 210 has a first end 212 attached to the rear arm 120 and a second end 214 attached to the front arm 122. As illustrated, the first and second ends 212, 214 of the extension cylinder 210 are a head end and a rod end of a hydraulically/pneumatically actuated cylinder respectively. In other embodiments, the first and second ends 212, 214 of the extension cylinder 210 may also be the rod end and the head end of a hydraulically/pneumatically actuated cylinder respectively. It should be understood that a similar combination of a rear arm with a lift cylinder and a front arm with an extension cylinder is provided on opposite side of the frame 102 of the machine complementing that of the rear arm 120 and the front arm 122.

The linkage assembly 104 further includes a tilt cylinder 216 having a first end 218 and a second end 220. As illustrated, the first and second ends 218, 220 of the tilt cylinder 216 are a head end and a rod end of a hydraulically/pneumatically actuated cylinder respectively. In other embodiments, the first and second ends 218, 220 of the tilt cylinder 216 may also be the rod end and the head end of a hydraulically/pneumatically actuated cylinder respectively. The first end 218 of the tilt cylinder 216 is pivotally coupled to a bracket 222 through a first end pin 224. The bracket 222 is attached to the rear arm 120 by welding. The bracket 222 may also be attached to the rear arm 120 through any other mechanical connection means such as mechanical fasteners, welding, brazing, etc. The bracket 222 may have an opening or a hole to allow the first end pin 224 to pass through and couple the tilt cylinder 216 with the bracket 222 at the first end 218 of the tilt cylinder 216. The second end 220 of the tilt cylinder 216 is attached to the quick coupler 107. A second tilt cylinder 226 is attached to the quick coupler 107 at the opposite end corresponding to the complementary arrangement of the rear arm and the front arm in a similar manner.

The quick coupler 107 is pivotally attached to the second end 220 of the tilt cylinder 216 and a distal end 228 of the front arm 122. The quick coupler 107 may be coupled to the second end 220 of the tilt cylinder 216 in a similar manner as the first end 218 of the tilt cylinder 216 is coupled with the bracket 222. The distal end 228 of the front arm 122 may also be similarly coupled with the quick coupler 107. The pivotal connections may be a conventional type of pivotal connection utilizing a pivot pin passing through openings in the parts to be connected or any similar means of pivotal connection as per the need of the present disclosure. Further, the work tool 106 is also attached to the quick coupler 107. Although, for the sake of simplicity and clarity, the work tool 106 is only shown in FIG. 1 and not shown in subsequent figures.

The work tool 106 may be adapted to engage, penetrate, or cut the surface at a worksite and may be further adapted to move the earth to accomplish a predetermined task. The work tool 106 is embodied as a bucket. Alternatively, the work tool 106 may be any other suitable implement that can be maneuvered via the tilt cylinder 216 coupled to the front and rear arms 120, 122 of the machine 100.

Movement of the work tool 106 is controlled through the quick coupler 107 by controlling movement of the rear arm 120, the front arm 122, and the tilt cylinder 216. Movement of the rear arm 120 and the front arm 122 together control a height of the work tool 106 relative to the ground surface. The tilt cylinder 216 is used to control angular orientation of the work tool 106. The control interface in the operator station 110 may include means to control the work tool 106 by controlling one or more of the lift cylinder 202, the extension cylinder 210, and the tilt cylinder 216. In an embodiment, the work tool 106 is controlled by an electro-hydraulic actuation mechanism. One or more of the lift cylinder 202, the extension cylinder 210 and the tilt cylinder 216 may be actuated by the electro-hydraulic actuation mechanism such that the work tool 106 follows a desired lift path.

The lift path may be defined as a set of instructions to control the various hydraulic actuators such that the work tool 106 follows a desired trajectory to perform a particular operation. A controller may be communicably coupled to the hydraulic actuators to control the lift path of the work tool 106. The controller may store a number of lift paths in an associated memory for different applications. For example, the lift path may describe the trajectory corresponding to a bucket loading condition with maximum loading. In another example, the lift path may describe the trajectory for a bucket loading condition with maximum fuel efficiency.

In the illustrated embodiment, the lift path corresponds to a vertical lift of the work tool 106. In such lift path, the work tool 106 follows a vertical trajectory perpendicular to the ground surface to suit a forklift application. Various application based set of instructions may be pre-programmed and stored in the memory of the controller or an external memory associated with the controller for execution and processing as per operational requirements of the machine 100. An output device such as screen, monitor, or any other visual display unit in the operator station 110 of the machine 100 to notify the operator of the lift path. In one embodiment, a set of predefined lift paths may be retrieved by the controller and displayed on the output device such that by using a suitable input device such as a touch screen, the operator may select the desired lift path from a list or collection of the predefined lift paths.

In an embodiment, the extension cylinder 210 is modified so that the extension cylinder 210 can retract the work tool 106 further inwards towards the machine 100 from a neutral position of the work tool 106 relative to the machine 100. The neutral position of the work tool 106 is defined as the position of the work tool 106 when the work tool 106 rests on the ground surface. The extension cylinder 210 is provided with an extra amount of distance to travel such that the extension cylinder 210 can retract the work tool 106 further inwards from the neutral position of the work tool 106. This modification in the extension cylinder 210 enables the work tool 106 to follow the vertical lift path effectively.

Figure 3:
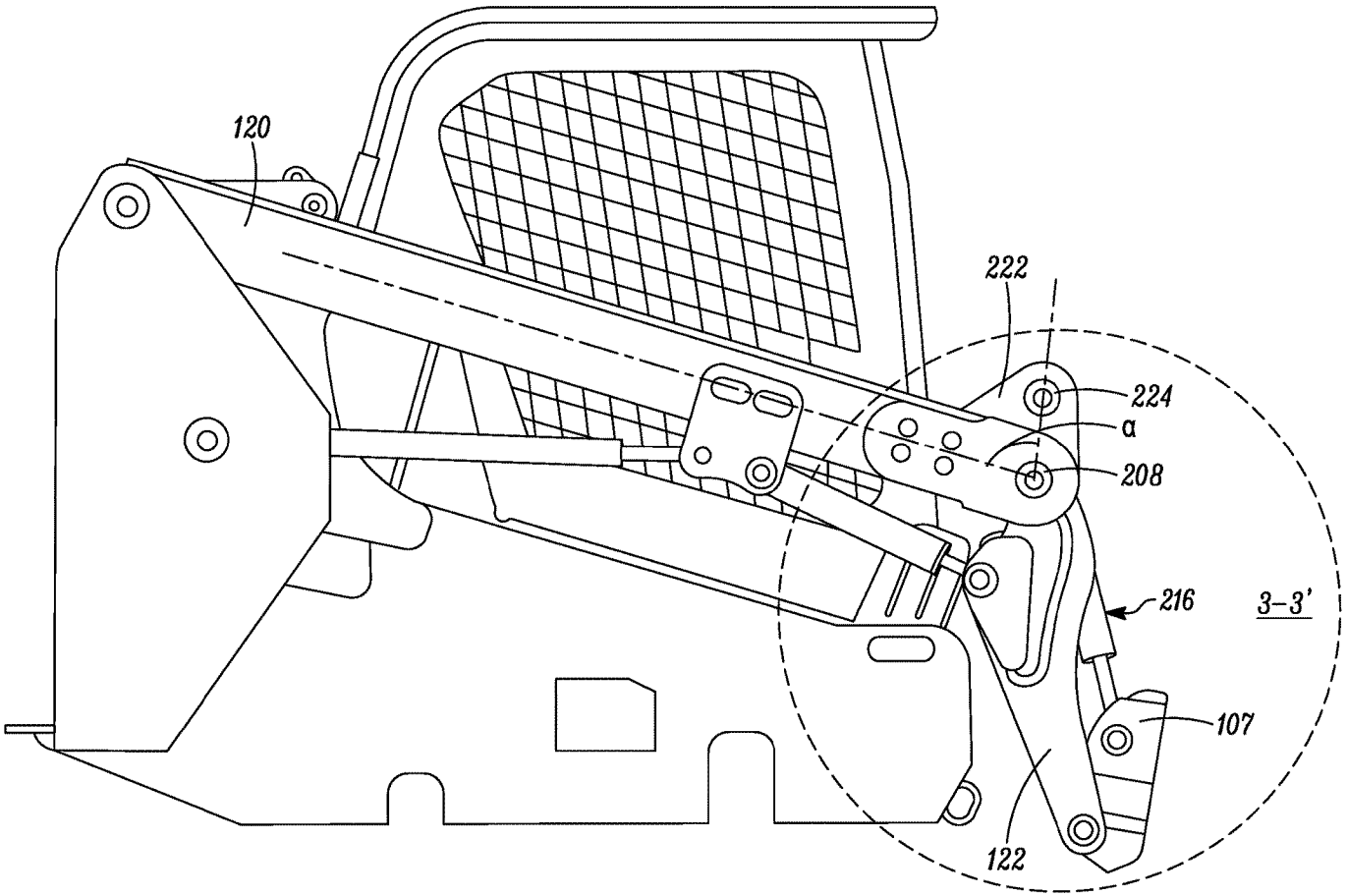
FIG. 3 is a side view of the linkage assembly of FIG. 2.
Figure 4:
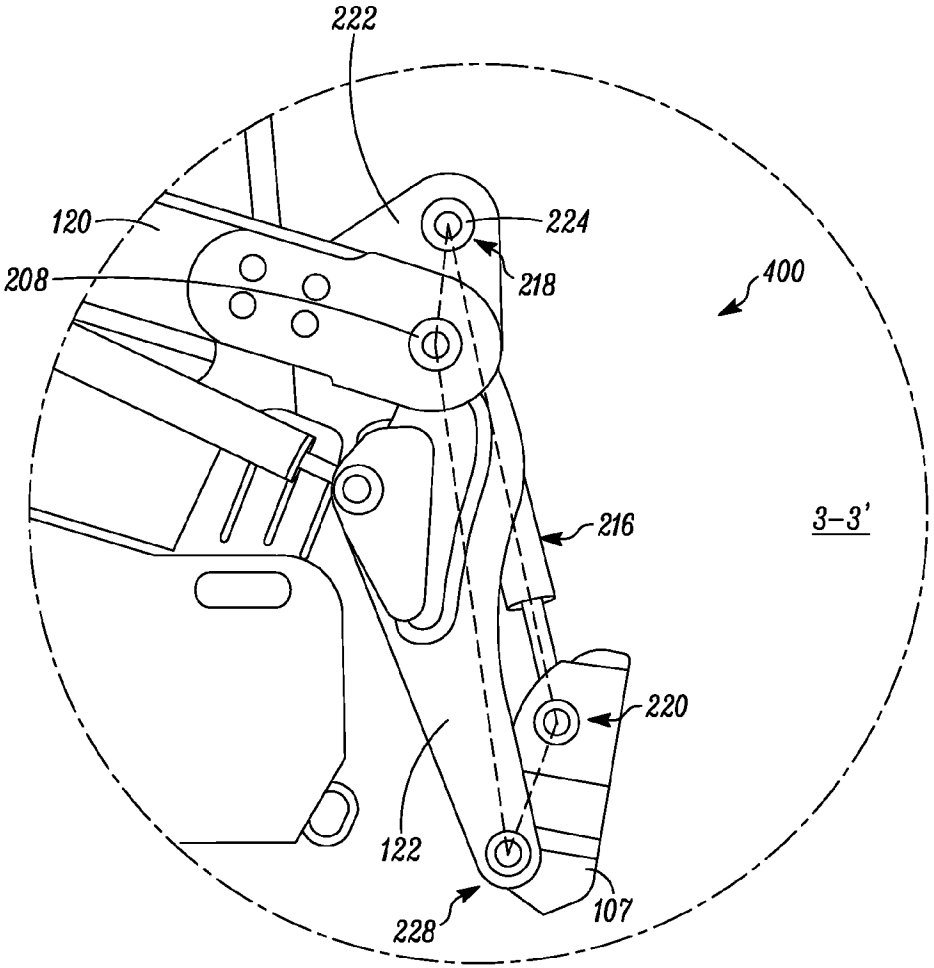
FIG. 4 is an enlarged view of an encircled portion 3-3' of FIG. 3, depicting a four-bar assembly of the linkage assembly.

Referring to FIGS. 3 and 4, the rear arm 120 and the first end pin 224 define an angle $\alpha$ at the arm pivot pin 208. The arm pivot pin 208 forms a vertex of the angle $\alpha$ defined between the rear arm 120 and the bracket 222. The bracket 222 extends angularly upwards from the rear arm 120 such that position of the arm pivot pin 208 is always ahead of the first end pin 224 if observed in a direction of forward travel of the machine 100. The angle $\alpha$ approximately lies in a range between 0 and 90 degrees. The range of angle $\alpha$ is such that the work tool 106 is prevented from rotating back into the operator station 110.

The movement of the work tool 106 is governed by movements of different members of a four-bar assembly 400 (see FIG. 4) associated with the linkage assembly 104. Referring to FIG. 4, the four-bar assembly 400 includes four vertices and corresponding four members connected at the vertices. The arm pivot pin 208 forms a first vertex of the four-bar assembly 400, connecting the rear arm 120 with the front arm 122. The distal end 228 of the front arm 122 forms the second vertex of the four-bar assembly 400, connecting the front arm 122 with the quick coupler 107. The first end pin 224 forms the third vertex of the four-bar assembly 400, connecting the bracket 222 with the tilt cylinder 216 at the first end 218 of the tilt cylinder 216. The second end 220 of the tilt cylinder 216 forms the fourth vertex of the four-bar assembly 400, connecting the second end 220 of the tilt cylinder 216 with the quick coupler 107. The front arm 122, the bracket 222, the tilt cylinder 216, and the quick coupler 107 form the four members of the four-bar assembly 400. In another embodiment, the work tool 106 may be connected directly with the front arm 122 and the tilt cylinder 216 without using the quick coupler 107. In such case, the work tool 106 may replace the quick coupler 107 as the fourth member of the four-bar assembly 400.

Different members of the four-bar assembly 400 are controlled to impart various types of movements to the work tool 106. For example, controlling the front arm 122 to rotate about the arm pivot pin 208 extends or retracts the work tool 106 outwards or inwards respectively with respect to the frame 102 of the machine 100. Similarly, an extent of extension of the tilt cylinder 216 may determine the angle of tilt of the work tool 106. It should be understood that a similar four-bar assembly (not shown) is provided on the opposite side of the work tool 106 corresponding to the other linkage assembly provided on the opposite side of the machine 100. Both the sets of linkage assemblies may be controlled in tandem to perform a particular operation by the machine 100.

INDUSTRIAL APPLICABILITY

The present disclosure relates to the four-bar assembly 400 for the linkage assembly 104. The linkage assembly 104 includes the rear arm 120 actuated by the lift cylinder 202, the front arm 122 actuated by the extension cylinder 210, the bracket 222, the tilt cylinder 216, the quick coupler 107 and the work tool 106. Position and orientation of the work tool 106 is controlled through the quick coupler 107 by controlling the various parts of the four-bar assembly 400 via the electro-hydraulic actuation mechanism. The structure and construction of the four-bar assembly 400 is such that the angle $\alpha$ formed between the rear arm 120 and the bracket 222 having the arm pivot pin 208 as the vertex thereof lies approximately between 0 and 90 degrees. Based on the positioning of the bracket 222 that extends angularly upwards with respect to the rear arm 120, and by maintaining the acute angle at the arm pivot pin 208, the four-bar assembly 400 inherently prevents the work tool 106 from swinging into or colliding with the operator station 102.

Further, the work tool 106 may be maneuvered along various lift paths by varying controls of the electro-hydraulic actuation mechanism associated with the linkage assembly 104. The operator may select the desired lift path from the set of the predefined lift paths, providing simplicity of operation control. This may greatly help new or novice operators to operate the machine 100 with ease.

Also, the range of angle $\alpha$ allows the work tool 106 to trace the vertical lift path. The tilt cylinder 216 may be appropriately operated to extend or retract in such a manner so as to make the work tool 106 trace the vertical lift path. Adopting such vertical lift paths may reduce or prevent spillage of material being lifted by the work tool 106. Additionally, lesser number of passes may be required for the designated operation than that required for a non-vertical lift path. This in turn may improve the productivity and efficiency of the machine 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A four-bar assembly for a linkage assembly, the four-bar assembly comprising:

an arm pivot pin pivotally coupling a front arm with a rear arm of the linkage assembly, wherein the arm pivot pin is adapted to form a first vertex of the four-bar assembly, and wherein a distal end of the front arm is adapted to form a second vertex of the four-bar assembly; and a tilt cylinder including a first end and a second end, the first end pivotally coupled to a bracket at a first end pin, the bracket angularly extending from the rear arm, wherein the first end pin is adapted to form a third vertex and the second end is adapted to form a fourth vertex of the four-bar assembly respectively, wherein an angle formed at the arm pivot pin and defined between the rear arm and the bracket is maintained between 0 and 90 degrees when a work tool attached to the second end of the tilt cylinder via a quick coupler moves along a straight vertical path from a first position to a second position.

2. The four-bar assembly of claim 1, wherein the first end of the tilt cylinder includes any one of a head end and a rod end.

3. The four-bar assembly of claim 1, wherein the tilt cylinder is actuated by an electro-hydraulic actuation mechanism.

4. The four-bar assembly of claim 1, wherein the work tool is adapted to move along a set path from a list of predefined lift paths.

5. The four-bar assembly of claim 1, wherein the extension cylinder is modified such that the work tool can be retracted further inwards from a neutral position of the work tool.

6. The four-bar assembly of claim 1, wherein the bracket is brazed or welded to the rear arm so as to extend angularly upwards from the rear arm and to define the angle.

7. The four-bar assembly of claim 1, wherein the bracket extends angularly upwards from the rear arm.

8. A linkage assembly for a machine, the linkage assembly comprising:

a front arm and an associated extension cylinder connected therewith;

a rear arm and an associated lift cylinder connected therewith; and a four-bar assembly associated with the front arm and the rear arm, the four-bar assembly comprising:

an arm pivot pin pivotally coupling the front arm with the rear arm, wherein the arm pivot pin is adapted to form a first vertex of the four-bar assembly, and wherein a distal end of the front arm is adapted to form a second vertex of the four-bar assembly; and a tilt cylinder including a first end and a second end, a work tool being removably attached to the second end of the tilt cylinder via a quick coupler, the first end pivotally coupled to a bracket at a first end pin, the bracket angularly extending from the rear arm, wherein the first end pin is adapted to form a third vertex and the second end is adapted to form a fourth vertex of the four-bar assembly respectively, wherein the work tool is adapted to move along a straight vertical path from a first position to a second position while an angle formed at the arm pivot pin and defined between the rear arm and the bracket lies between 0 and 90 degrees.

9. The linkage assembly of claim 8, wherein the bracket extends angularly upwards from the rear arm.

10. The linkage assembly of claim 8, wherein the first end of the tilt cylinder includes any one of a head end and a rod end.

11. The linkage assembly of claim 8, wherein the extension cylinder, the lift cylinder, and the tilt cylinder are actuated by an electro-hydraulic actuation mechanism.

12. The linkage assembly of claim 8, wherein the extension cylinder is modified such that the work tool can be retracted further inwards from a neutral position of the work tool.

13. The linkage assembly of claim 8, wherein the work tool is adapted to move along a set path from a list of predefined lift paths.

14. A machine comprising:

a frame;

a linkage assembly coupled to the frame, the linkage assembly comprising:

a front arm and an associated extension cylinder connected therewith;

a rear arm and an associated lift cylinder connected therewith; and a four-bar assembly associated with the front arm and the rear arm, the four-bar assembly comprising:

an arm pivot pin pivotally coupling the front arm with the rear arm, wherein the arm pivot pin is adapted to form a first vertex of the four-bar assembly, and wherein a distal end of the front arm is adapted to form a second vertex of the four-bar assembly; and a tilt cylinder including a first end and a second end, the first end pivotally coupled to a bracket at a first end pin, the bracket angularly extending from the rear arm, wherein the first end pin is adapted to form a third vertex and the second end is adapted to form a fourth vertex of the four-bar assembly respectively, wherein an angle formed at the arm pivot pin and defined between the rear arm and the bracket lies between 0 and 90 degrees; and a work tool coupled to the second end of the tilt cylinder and the distal end of the front arm via a quick coupler, wherein the work tool is adapted to move along a straight vertical lift path from a first position to a second position while the angle lies between 0 and 90 degrees.

15. The machine of claim 14, wherein the bracket extends angularly upwards from the rear arm.

16. The machine of claim 14, wherein the extension cylinder is modified such that the work tool can be retracted further inwards from a neutral position of the work tool.

17. The machine of claim 14, wherein the first position overlaps the frame and the second position is above the frame.

18. The machine of claim 14, wherein the extension cylinder, the lift cylinder, and the tilt cylinder are actuated by an electro-hydraulic actuation mechanism.

* * * * *